US006631588B1

(12) United States Patent
Distler

(10) Patent No.: US 6,631,588 B1
(45) Date of Patent: Oct. 14, 2003

(54) CLOG-FREE ROOF DRAIN COVER

(76) Inventor: John W. Distler, 34 Wagon Wheel Rd., Redding, CT (US) 06896

( * ) Notice: Subject to any disclaimer, the term of this patent is extended or adjusted under 35 U.S.C. 154(b) by 0 days.

(21) Appl. No.: 10/100,939

(22) Filed: Mar. 19, 2002

(65) Prior Publication Data

(65)

(51) Int. Cl.[7] ..... E04B 1/70; E03F 5/06; E03F 5/14; E04D 13/00

(52) U.S. Cl. ..... 52/12; 52/302.1; 210/163; 210/166

(58) Field of Search ..... 52/12, 302.1, 198; 210/242.1, 163, 166, 342, 337, 338, 122, 489, 497.3

(56) References Cited

U.S. PATENT DOCUMENTS

| | | | | | |
|---|---|---|---|---|---|
| 2,079,269 | A | * | 5/1937 | Williams | 138/32 |
| 3,469,698 | A | * | 9/1969 | Blendermann | 210/163 |
| 3,469,699 | A | * | 9/1969 | Blendermann | 210/166 |
| 4,035,297 | A | * | 7/1977 | Aldridge et al. | 210/163 |
| 4,107,929 | A | * | 8/1978 | Ebeling et al. | 405/119 |
| 4,112,691 | A | * | 9/1978 | Ebeling et al. | 405/119 |
| 4,400,272 | A | * | 8/1983 | Logsdon | 210/166 |
| 4,652,365 | A | * | 3/1987 | Ebeling | 210/163 |
| 4,961,848 | A | | 10/1990 | Logsdon | |
| 5,234,582 | A | | 8/1993 | Savoie | |
| 5,394,657 | A | * | 3/1995 | Peterson | 52/12 |
| 5,469,670 | A | * | 11/1995 | Thaler | 52/12 |
| 5,522,197 | A | * | 6/1996 | Ebeling | 52/741.1 |
| 5,526,613 | A | | 6/1996 | Simeone, Jr. | |
| 5,615,526 | A | * | 4/1997 | Palmer et al. | 52/302.1 |
| 5,618,416 | A | | 4/1997 | Haefner | |
| 5,689,928 | A | * | 11/1997 | Rasksen | 52/302.1 |
| 5,702,596 | A | * | 12/1997 | Juple et al. | 210/166 |
| 5,735,091 | A | * | 4/1998 | Hawkins et al. | 52/302.7 |
| 5,966,884 | A | | 10/1999 | Uglow | |
| 6,165,357 | A | | 12/2000 | Cormier | |
| 2001/0023842 | A1 | * | 9/2001 | Singleton | 210/163 |

* cited by examiner

*Primary Examiner*—Carl D. Friedman
*Assistant Examiner*—Kevin McDermott
(74) *Attorney, Agent, or Firm*—Gordon & Jacobson, P.C.

(57) ABSTRACT

A clog-free roof drain cover assembly includes a first drain cover fixed over the drain, and a second drain cover which is vertically movable relative to the first drain cover. The second drain cover includes a base provided with weep holes, a skirt located above the weep holes, a hat-shaped portion provided with slots, and a foam ring about the hat-shaped portion. During light rains, water flows under the skirt and through the weep holes, into the first drain cover, and into the drain. During heavy rains, debris becomes caught in the debris skirt. When the pooling water reaches a predetermined level, the foam ring floats, raising the second drain cover, which causes the debris skirt to lift the debris about the drain and permit water to pass freely underneath, into the first drain cover, and down the drain.

20 Claims, 2 Drawing Sheets

CLOG-FREE ROOF DRAIN COVER

BACKGROUND OF THE INVENTION

1. Field of the Invention

This invention relates broadly to roof drain covers. More particularly, this invention relates to roof drain covers that are adapted to remain clog-free.

2. State of the Art

Industrial and commercial buildings often have flat roofs. These roofs are provided with drains to remove standing water. The drains are provided with covers to catch leaves and other debris and prevent the debris from entering and clogging the drain pipe. The covers are typically hat-shaped grates or strainers defined by upright sidewalls having vertical slots through which water may exit into the drain. The slotted side walls prevent the passage of debris.

When debris flows-toward the drain and is stopped by the cover, the debris tends to clog the cover and prevent even the passage of water from the roof into the drain. This causes water to pool on the roof about the drain, and may result in roof damage, leaks into the interior of the building, and water pouring over the side of the building.

SUMMARY OF THE INVENTION

It is therefore an object of the invention to provide a drain cover assembly which is not susceptible to clogging.

It is another object of the invention to provide an anti-clog assembly which may be retrofit to an existing drain.

It is a further object of the invention to provide a retrofittable anti-clog assembly which is relatively easy to install.

In accord with these objects, which will be discussed in detail below, a clog-free roof drain cover assembly includes a first drain cover fixed over the drain, and a second drain cover be which is vertically movable relative to the first drain cover. The second drain cover includes a base provided with a plurality of weep holes, a debris skirt located above the weep holes, an upstanding preferably frustoconical hat-shaped portion provided with preferably vertical slots, and a closed-cell foam ring about the hat-shaped portion.

During light rains, water flows under the debris skirt and through the weep holes, into the first drain cover, and into the drain. During heavy rains, debris that normally clogs a fixed roof drain gets caught in the debris skirt and vertical openings of the second drain cover. When the pooling water reaches the level of the closed cell foam ring, the second drain cover begins to float, and the debris skirt thereon lifts the debris about the drain thereby allowing water to pass freely underneath, through the first drain cover, and down the drain.

The clog-free drain cover assembly may be installed during new construction or replacement roof work. Alternatively, it is appreciated that a retrofit assembly may be provided for use with existing roof drains covers. That is, in a retrofit assembly, existing drain covers comprise the first drain cover of the clog-free drain cover assembly, and the second drain cover and means for mounting the second drain cover over the first drain cover such that the second drain cover may move vertically relative to the first drain cover are additionally provided.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
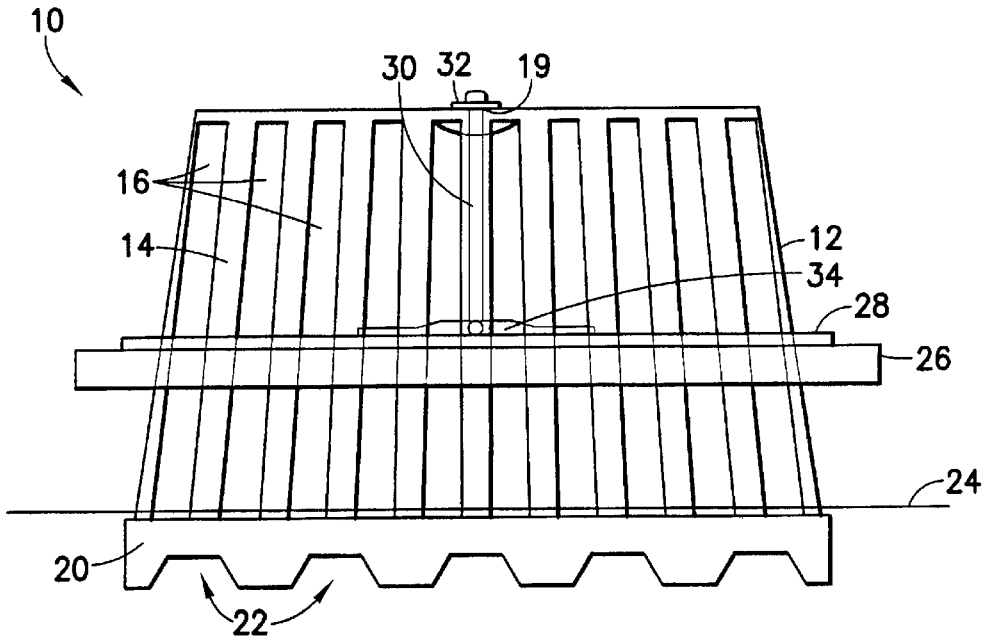
FIG. 1 is a transparent side elevation view of a clog-free drain assembly according to the invention for retrofit applications.
Figure 2:
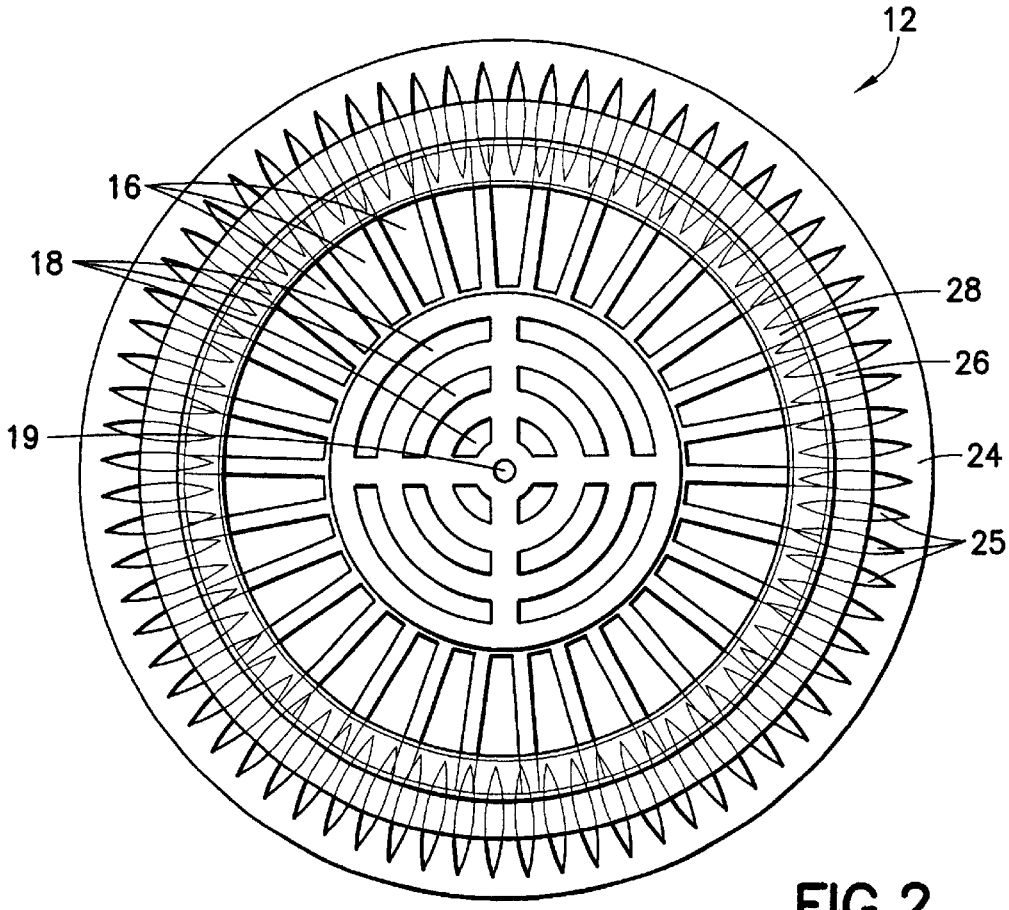
FIG. 2 is a transparent top view of the clog-free drain assembly according to the invention for retrofit applications.

Turning now to FIGS. 1 and 2, a clog-free drain cover assembly 10, particularly adapted for retrofit use over existing drain covers on roof drains, is shown. The retrofit drain cover assembly 10 includes a drain cover 12 having an upstanding preferably frustoconical hat-shaped portion 14 molded or otherwise formed with a plurality of preferably vertical slots 16, upper curved slots 18, and central top hole 19. The bottom of the drain cover 12 defines a preferably circular base 20 (adapted to seat at roof level) provided with a plurality of weep holes 22. The drain cover 12 is preferably made from plastic or another relatively low density material. A debris skirt 24, preferably approximately 2.5 inches wide, is located just above the base 20, and includes a plurality of radial slots 25. A closed-cell foam ring 26 is provided about a central portion of the hat-shaped portion 14, preferably approximately 2.5 inches above the bottom of the base 20. A preferably plastic flange 28, preferably having a width of approximately 0.5 inch, fixes the foam ring 26 in place.

Figure 3:
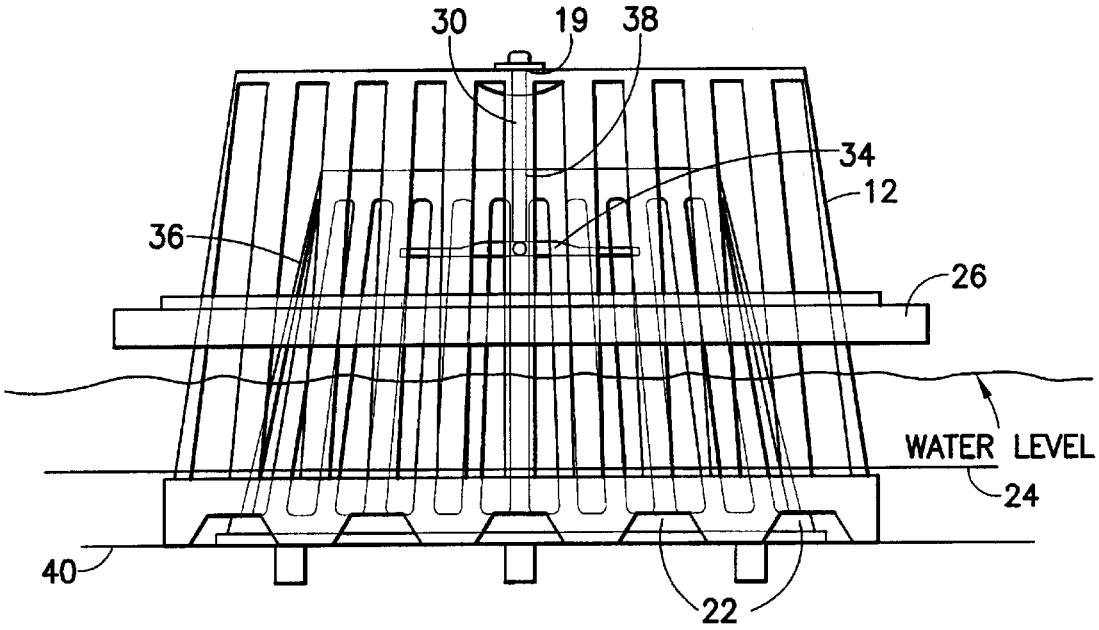
FIG. 3 is a transparent side elevation view of the clog free drain assembly according to the invention, with fixed and movable drain covers, in a low water level situation.

Referring to FIG. 3, the drain cover assembly 10 also includes a substantially smooth bolt 30 provided with a head 32 at its upper end and a toggle 34 at its lower end.

Still referring to FIG. 3, in assembly, the drain cover 12 is positioned over an existing drain cover 36 on a roof 40. The bolt 30 is then inserted through the top hole 19 and into a central top hole 38 of the existing drain cover 36. If no such hole 38 exists in the existing drain cover 36, the hole is drilled in the existing drain cover. The toggle 34 is positioned parallel to the bolt 30 during the insertion, but toggled relative thereto after insertion into the hole 38 in the existing drain cover 36. This couples the drain cover 12 relative to existing drain cover 36, yet permits the drain cover 12 to ride vertically relative to the existing drain cover 36.

Still referring to FIG. 3, during rain which does not cause the water level on the roof 40 to rise above the foam ring 26, water flows under the debris skirt 24 and through the weep holes 22, through the existing drain cover 36, and down the drain (not shown).

Figure 4:
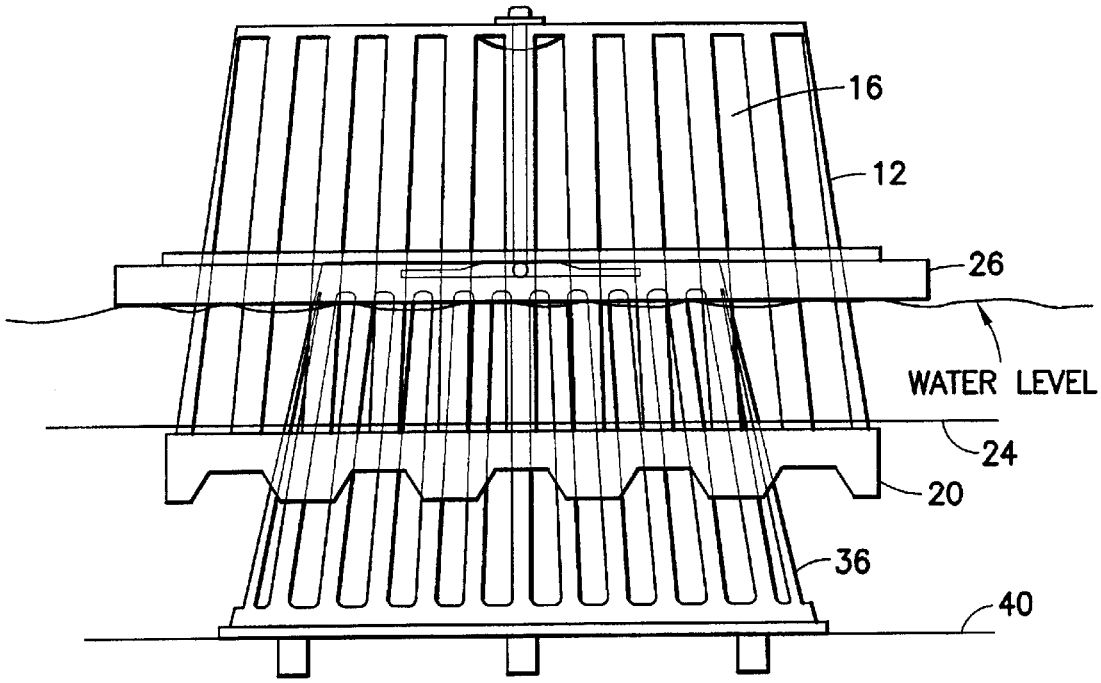
FIG. 4 is a transparent side elevation view of the clog free drain assembly according to the invention, with fixed and movable drain covers, in a high water level situation.

Referring now to FIG. 4, during heavy rains, debris gets caught in the debris skirt 24 and slots 16, 18 of the drain cover 12. When the pooling water on the roof 40 exceeds the level at which the closed cell foam ring 26 is normally located when the base 20 rests on the roof 40, the ring floats on the water, raising up the drain cover 12. As the drain cover rises, the debris skirt 24 lifts the debris about the drain, and water on the roof 40 is permitted to pass freely underneath, through the existing drain cover 36, and down the drain.

While the above described embodiment includes a low density closed-cell foam ring, it is appreciated that other elements of the assembly may comprise a low density material and the ring can be eliminated. That is, e.g., the hat-shaped portion or the debris skirt may comprise a sufficiently low density material such that the drain cover is caused to float upon a pooling of a depth of water; i.e., without the use of an additional low density ring. More particularly, by way of example, the hat-shaped portion may comprise a hollow or foam-filled plastic structure.

While the above described drain cover assembly 10 is adapted to be retrofit over an existing drain cover, it is appreciated that the clog-free drain cover assembly may be provided for new construction, replacement roof work, or for those wishing to replace the existing drain covers on a roof for whatever reason. In such an embodiment, a second drain cover adapted to be fixedly located over a roof drain and sized to fit within the clog-free cover is provided with the assembly.

There have been described and illustrated embodiments of a clog-free roof drain cover assembly. While particular embodiments of the invention have been described, it is not intended that the invention be limited thereto, as it is intended that the invention be as broad in scope as the art will allow and that the specification be read likewise. Thus, while particular slot configuration for the drain cover have been disclosed, it will be appreciated that any slot configuration permitting the passage of water can be used. In addition, while it is preferred to couple the two drain covers together with a central bolt, it will be appreciated that multiple bolts can be used, as well as any other coupling which permits one drain cover to move vertically relative to the other drain cover. Also, while the ring is preferably made from a closed-cell foam, it is understood that other materials having a density less than water may be used, as well. Furthermore, while the hat-shaped portion and debris skirt are described as having a plurality of slots, it will be appreciated that they may be provided with any openings permitted the passage of water. It will therefore be appreciated by those skilled in the art that yet other modifications could be made to the provided invention without deviating from its spirit and scope as claimed.

What is claimed is:

1. A drain cover assembly for a water drain on a roof, comprising:

a) a first drain cover adapted to be fixed over the drain; and b) a second drain cover coupled to said first drain cover such that said second drain cover is vertically movable relative to said first drain cover, said second drain cover including an upstanding portion defining a plurality of water passage openings and provided with a debris skirt, and an element having a density less than water, said element having sufficient structure to cause said second drain cover to rise when a water level on the roof exceeds a vertical location of said element.

2. A drain cover assembly according to claim 1, wherein:

said element is a ring.

3. A drain cover assembly according to claim 2, wherein:

said ring comprises a closed-cell foam.

4. A drain cover assembly according to claim 2, wherein:

said ring is located approximately 2.5 inches from a bottom of said second drain cover.

5. A drain cover assembly according to claim 1, wherein:

said element comprises a closed-cell foam.

6. A drain cover assembly according to claim 1, wherein:

said second drain cover is coupled to said first drain cover with a bolt and a toggle.

7. A drain cover assembly according to claim 1, wherein:

said debris skirt defines plurality of water passage openings.

8. A drain cover assembly according to claim 1, wherein:

said debris skirt has a width of approximately two inches.

9. A drain cover assembly according to claim 1, wherein:

said second cover includes a base defining a plurality of weep holes.

10. A drain cover assembly for a water drain on a roof, comprising:

a) a first drain cover adapted to be fixed over the drain; and b) a second drain cover coupled to said first drain cover such that said second drain cover is vertically movable relative to said first drain cover, said second drain cover including an upstanding portion provided with a debris skirt and defining a plurality of water passage openings, wherein one of said upstanding portion and said debris skirt has a density less than water and sufficient structure to cause said second drain cover to rise when pooling water on the roof exceeds a level.

11. A drain cover assembly according to claim 10, wherein:

said second drain cover is coupled to said first drain cover with a bolt and a toggle.

12. A drain cover assembly according to claim 11, wherein:

said debris skirt defines a plurality of water passage opening.

13. A drain cover assembly according to claim 11, wherein:

said debris skirt has a width of approximately two inches.

14. A drain cover assembly according to claim 11, wherein:

said second cover includes a base defining a plurality of weep holes.

15. A retrofit drain cover for use over an existing drain cover for a water drain on a roof, said clog-free drain cover comprising:

a retrofit drain cover adapted to be coupled over the existing drain cover such that said drain cover is vertically movable relative to the existing drain cover, said retrofit drain cover including an upstanding portion defining a plurality of water passage openings, and provided with a debris skirt and an element having a density less than water, said element having sufficient structure to cause said retrofit drain cover to rise when a water level on the roof exceeds a vertical location of said element.

16. A drain cover according to claim 15 wherein:

said element is ring.

17. A drain cover according to claim 15, wherein:

said element comprises a closed-cell foam.

18. A drain cover according to claim 15 wherein:

said second drain cover is coupled to said first drain cover with a bolt and a toggle.

19. A retrofit drain cover for use over an existing drain cover for a water drain on a roof, said clog-free drain cover comprising:

a retrofit drain cover adapted to be coupled over the existing drain cover such that said retrofit drain cover is vertically movable relative to the existing drain cover, said retrofit drain cover including an upstanding portion provided with a debris skirt and defining a plurality of water passage openings, wherein at least one of said upstanding portion and said debris skirt has a density less than water and sufficient structure to cause said retrofit drain cover to rise when pooling water on the roof exceeds a level.

20. A drain cover according to claim 19, further comprising:

a bolt and a toggle adapted to be couple said retrofit drain cover to the existing drain cover.

* * * * *